US008234807B2

(12) United States Patent
LaTorre et al.

(10) Patent No.: US 8,234,807 B2
(45) Date of Patent: Aug. 7, 2012

(54) HIGH FEED RAMP FOR COLT 1911 STYLE HANDGUNS

(76) Inventors: Antonino LaTorre, Rome (IT); Antonio Fugazzotto, Rome (IT)

( * ) Notice: Subject to any disclaimer, the term of this patent is extended or adjusted under 35 U.S.C. 154(b) by 64 days.

(21) Appl. No.: 12/799,109

(22) Filed: Apr. 19, 2010

(65) Prior Publication Data

US 2010/0269390 A1 Oct. 28, 2010

Related U.S. Application Data

(60) Provisional application No. 61/214,098, filed on Apr. 20, 2009.

(51) Int. Cl.
*F41A 3/00* (2006.01)

(52) U.S. Cl. ..... 42/28; 42/29; 42/16; 42/17; 42/18; 42/22; 42/34; 42/35; 42/7

(58) Field of Classification Search ..... 42/28, 29, 42/16, 17, 34, 35, 18, 22, 7
See application file for complete search history.

(56) References Cited

U.S. PATENT DOCUMENTS

| | | | | |
|---|---|---|---|---|
| 6,070,512 | A * | 6/2000 | Rohrbaugh | 89/147 |
| 6,276,252 | B1 * | 8/2001 | Dionne | 89/29 |
| 7,047,686 | B2 * | 5/2006 | Zimmermann | 42/75.1 |
| 2011/0289813 | A1 * | 12/2011 | Serandour | 42/76.01 |

* cited by examiner

*Primary Examiner* — J. Woodow Eldred
(74) *Attorney, Agent, or Firm* — Dara L. Onofrio, Esq.; Onofrio Law

(57) ABSTRACT

A high feed ramp for use in Colt 1911 style handguns including a feed ramp on the frame (receiver) for guiding bullets into the barrel of the gun; a boiler room (barrel breech) with a small chamfered around its entire inner circumference; and an integral relief rim extension on the upper edge of the feed ramp, such that the feed ramp is extended over the bottom edge of the chamfered boiler room; wherein when the handgun is fired the bullets easily enter into the barrel and do not jam or misfire.

4 Claims, 8 Drawing Sheets

HIGH FEED RAMP FOR COLT 1911 STYLE HANDGUNS

This application claims the benefit of U.S. provisional application No. 61/214,098 filed Apr. 20, 2009, which is incorporated herein in its entirety by reference.

FIELD OF THE INVENTION

The present invention relates to a high feed ramp on the frame of a handgun with an integral relief extension on the upper edge of the feed ramp such that when the gun is fired flat point bullets are easily released into the barrel without jumping or jamming on the bottom edge blade of the chamfered barrel breech. In particular, the modified feed ramp is used in the Colt 1911 style handgun to improve feeding of bullets.

BACKGROUND OF THE INVENTION

Handguns, such as models like the Colt 1911, have been around for almost 100 years. They were developed and used with mainly round tipped bullets. Today flat nose and hollow point bullets are commonly used. When these later bullets are used in handgun models like the Colt 1911 they typically misfire and jam. If the handgun is used as a protective device this can cause serious if not fatal consequences.

The prior art has tried to solve this problem by modifying the magazine carrying the bullets. For example, U.S. Pat. No. 5,615,505 to Vaid describes an improved cartridge magazine for a semi-automatic pistol adapted to be loaded with horizontally and vertically stacked cartridges or bullets. The magazine itself is adapted to overcome the occurrences of misfires and jams resulting from the use in such magazines shorter than conventional length cartridges, including hollow point and flat nose bullets.

In addition, U.S. Pat. Nos. 7,047,686 and 7,318,294 B2 to Zimmermann discloses an improved magazine which has crimped feed lips which feed rebated rim cartridges into a handgun or rifle without nose-diving. The magazine has a metal-reinforced follower which extends the operational life of the magazine. Patent '686 specifically describes an improved M1911-style handgun the uses redistributed masses for a slide and bull barrel to reduce perceived recoil and muzzle flip when the gun is fired.

The present invention improves the feed of the semi-wad cutter bullet of a system like the Colt 1911 or other similar guns, without feed ramp on the barrel chamber, by providing an extra long feed ramp on the receiver.

The modified feed ramp on the receiver (or frame) was created by milling on the receiver metal to form an integral little relief rim extension on the upper edge of the frame feed ramp of the handgun. Preferably, the invention is for the Colt system 1911-45ACP having a "drop barrel" mechanism. When fired, the flat point bullet easily enters into (chambers) the barrel without jamming on the bottom edge blade of the chamfered barrel breech and do not misfire.

The prior art patents modify the magazine and do not modify the handgun itself. An advantage of the present invention over the prior art is when the gun fires the little integral relief rim extension drives the flat point bullets easily into the barrel boiler (breech) room without jamming. The flat point bullet, when a fresh cartridge is chambering into the barrel, slides on the little relief rim extension on the frame feed ramp and do not collide with the bottom edge blade of the inner chamfered barrel breech avoiding jamming.

A general objective of the invention is to avoid the semi wad-cutter bullet point jam and jerk on the bottom edge blade of the chamfered barrel breech. This invention allows a full length case chamber to support all surface of case during the firing.

Another advantage of the invention is in providing a boiler room (barrel breech) without a large chamfered breech around its entire inner circumference, in such a way that the boiler room can support the pressure on the entire case surface upon firing.

Another objective of the invention is to allow a user to fire the semi-wad cutter bullet point without jam or jerk.

Another objective of the invention is to provide a new feed ramp on the frame with integral relief rim extension on its upper edge for system Colt 1911 to fire flat point 45 ACP bullets.

Another objective of the invention is to provide a good solution to the problem of a jam of a cast bullet with a modification to the feed ramp on the frame avoiding the costs of changing production machinery.

A further object of the invention is the ability to fire a variety of semi wad-cutter bullet point shapes without jam and jerk.

SUMMARY OF THE INVENTION

In the present invention, these purposes, as well as others which will be apparent, are achieved generally by providing a long high feed ramp for use in Colt 1911 style handguns. The invention ramp is on the receiver frame of the handgun and is comprised of an integral rim extension on the upper edge of the frame feed ramp that extends over to the bottom edge of the chamfered boiler room (barrel breech).

The boiler room is also with a small chamfered breech such that when the handgun is fired the bullets easily enter the barrel and do not jam or misfire.

A related handgun is also provided that includes a high feed ramp on the frame (receiver) for guiding bullets into the barrel of the gun; a boiler room (barrel breech) with a small chamfered around its entire inner circumference; an integral relief rim extension on the upper edge of the feed ramp, such that the feed ramp is extended over the bottom edge of said chamfered boiler room; and a full length barrel. The gun has no barrel feed ramp edge blades and the bullets can easily enter into the barrel and do not jam or misfire when the handgun has been fired.

Other objects, features and advantages of the present invention will be apparent when the detailed description of the preferred embodiments of the invention are considered with reference to the drawings, which should be construed in an illustrative and not limiting sense.

BRIEF DESCRIPTION OF THE DRAWINGS

FIG. 1A is a top illustration of the feed ramp in a Colt 1911 style handgun manufactured by Colt; FIG. 1B is a cross section of the same handgun;

FIG. 2A is a top illustration of the extra feed ramp in a Colt 1911 style handgun; FIG. 2B is a cross section of the same handgun according to the invention;

FIG. 3A is a top illustration of the extra long feed ramp in a Colt 1911 style handgun; FIG. 3B is a cross section of the same handgun showing the extra long-high feed ramp according to the invention;

DETAILED DESCRIPTION OF THE INVENTION

In accordance with the present invention a long high feed ramp for use in Colt 1911 style handguns is provided. The ramp is on the receiver frame of the handgun and is comprised of an integral relief rim extension on the upper edge of the frame feed ramp such that the feed ramp is extended over to the bottom edge of the chamfered barrel breech. The boiler room is also with a small chamfered breech around its inner circumference so that when the handgun is fired the bullets easily enter the barrel and do not jam or misfire. As described in the accompanying drawings the structures of the invention device are labeled as follows:

1—Low feed ramp edge
2—Barrel
3—Barrel feed ramp blad
4—Old chamber
10—Frame or Receiver
20—Relief rim (extra high feed ramp)
21—Dove tail steel plate insert
30—Feed ramp
31—High feed ramp with integral relief rim
32—Full length barrel chamber
40—Relief rim extension
41—Barrel breech: chamber or boiler room
42—Small chamfered around the inner breech
43—Wall of the barrel
44—Drop barrel
45—High feed ramp
46—Slide
50—Short feed ramp
51—Boiler room
52—Bottom barrel edge blade of the inner chamfered breech
53—Barrel
60—Relief rim extension
61—Barrel breech: chamber or boiler room
62—Small chamfered around the inner breech
63—Wall of the barrel
64—Drop barrel
65—High feed ramp
66—Slide
70—Relief rim extension on upper edge of frame
80—High feed ramp
81—Barrel The dimension of the high frame feed ramp of the invention is preferably 7.086 pt (2.5 mm), much longer than the standard short frame feed ramp.

As used in this application the term handgun includes semi-automatic pistols, most preferably, the Colt 1911 45 ACP drop barrel.

Figure 1A:
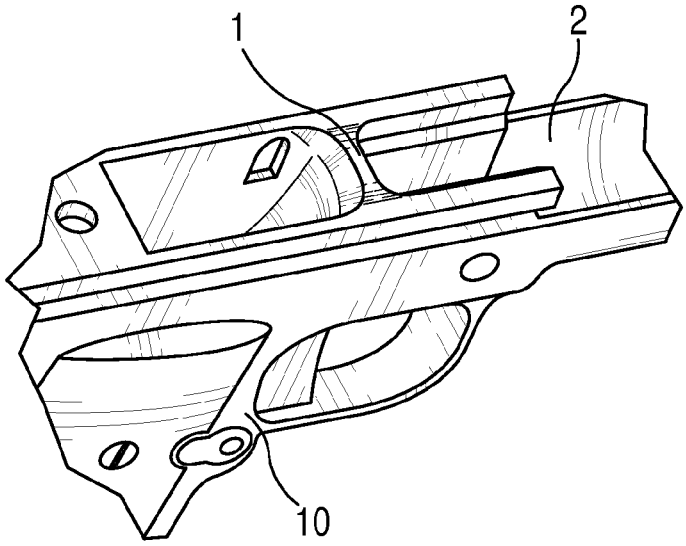
FIG. 1A PRIOR ART
FIGS. 1A and 1B illustrate the prior art short-low feed ramp.
Figure 1B:
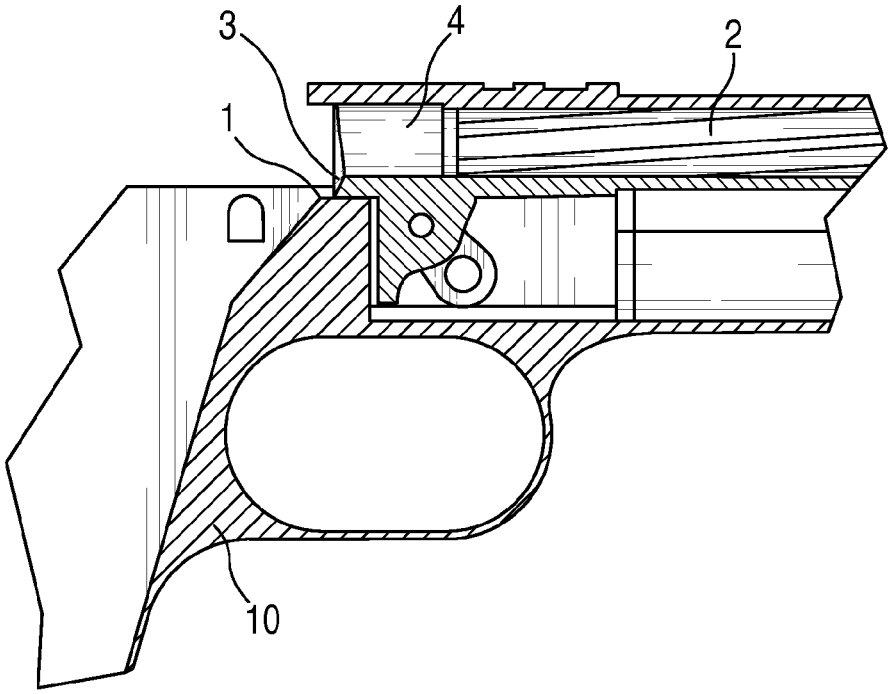
FIG. 1B PRIOR ART
Figure 2A:
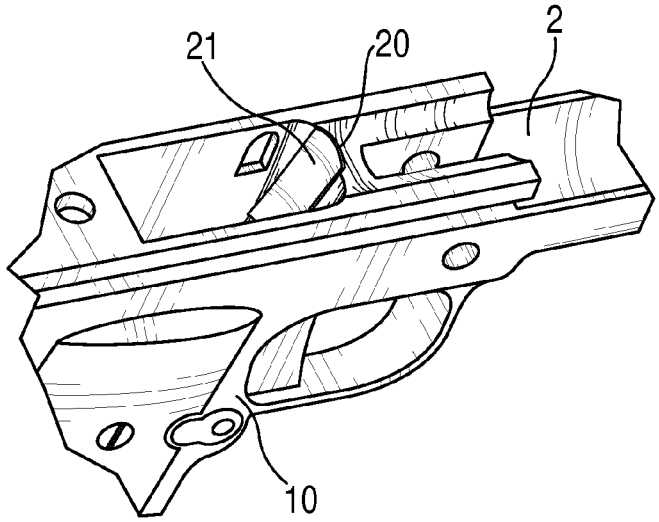
FIGS. 2A and 2B illustrate the long-high feed ramp according to the invention.
Figure 2B:
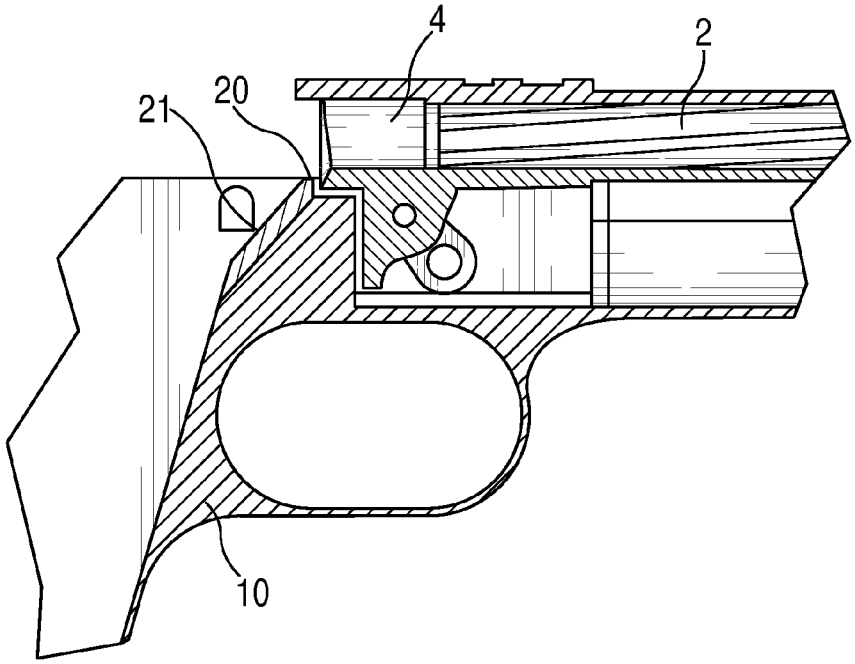
Figure 3A:
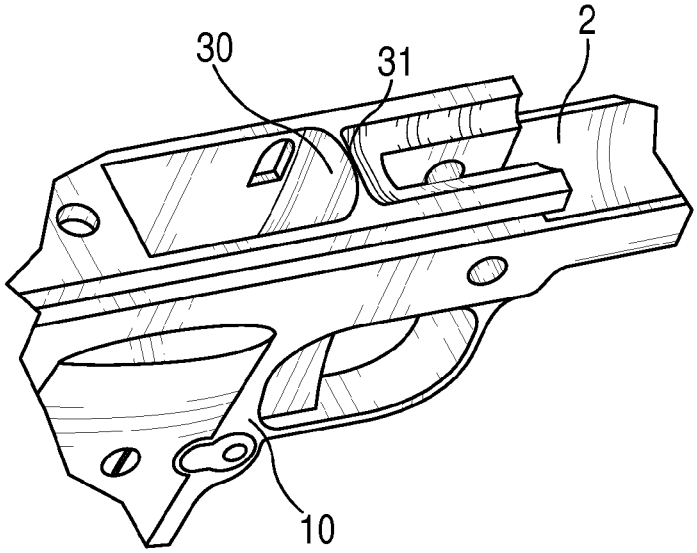
FIGS. 3A and 3B illustrate the extra long-high feed ramp according to the invention.
Figure 3B:
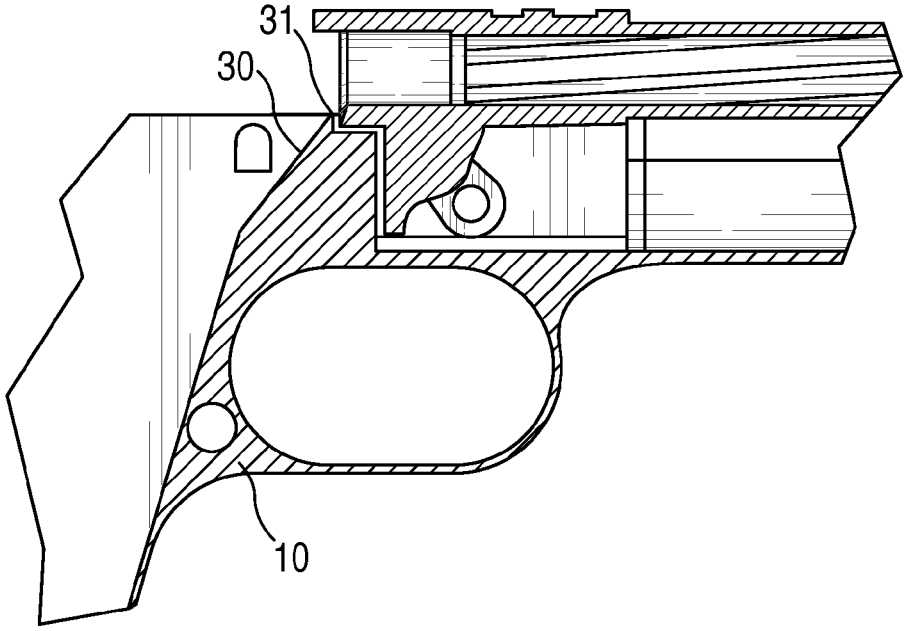

FIGS. 1A, 1B and FIG. 5 illustrate the prior art; FIGS. 2A and 2B illustrate the method and modification by the inventor; and FIGS. 3A, 3B and 4 illustrate the structure of the present invention.

More specifically, FIGS. 1A and 1B illustrate the Colt factory ramp which is a short or low feed ramp without a relief rim. FIG. 1A is a top illustration of the feed ramp in a Colt 1911 style handgun and shows the low feed ramp edge 1, the frame or receiver 10 and the inner part of the barrel 2.

FIG. 1B is a cross section of the same handgun and indicates more detail. In this model, due to the barrel feed ramp 3 a full chamber is not possible. There is an old chamber 4 but there is no full-length chamber, such a structure is not supported in this model. The barrel 2 and frame or receiver 10 are also shown. In this model with a low ramp the point of a cast bullet won't slide easily into the barrel and jams occur.

FIGS. 2A and 2B illustrate the long or high feed ramp according to the invention. FIG. 2A is a top illustration of the extra or high feed ramp 20 in a Colt 1911 style handgun. The ramp includes an integral steel plate relief rim FIG. 2B is a cross section of the same handgun according to the invention and represents the artcraft work made on the 1911 Rock Island Armory which was modified with a plate dove tail 21 inserted on the receiver to create the high feed ramp 20 according to the invention. The modified handgun now can fire flat point bullets without jamming. The barrel 2, old chamber 4 and the frame or receiver 10 are also shown.

FIGS. 3A and 3B illustrate the extra long or high feed ramp according to the invention. FIG. 3A is a top illustration of the extra long feed ramp in a Colt 1911 style handgun. As an alternate to the dove tail steel plate insert as described in FIGS. 2A and 2B, the ramp according to the invention can be machinated on the receiver metal. The feed ramp 30 and the extra long or high feed ramp with a little integral relief rim on the upper edge 31 of the frame is shown. The barrel 2 and the frame or receiver 10 is also illustrated.

FIG. 3B is a cross section of the same handgun showing the extra long or high feed ramp according to the invention. The feed ramp 30 and the new extra long or high feed ramp 31 is shown machinated on the receiver with a little integral relief rim on the upper edge. A new full length chamber 32 supporting all the surface of case, since there is no barrel feed ramp blade during firing. The extra long or high feed ramp 31 is integral on the receiver to drive the point of a cast bullet, or any bullet, into the chamber without edge blade slides on the barrel ramp, the edge blades aren't necessary. The barrel feed ramp edge blades are eliminated and make it possible a full length chamber that supports all surface of cases during firing. Consequently there is no longer a possibility of grabby or jamming of point cast bullets on the barrel feed ramp blade because it isn't there.

Figures 4A, 4B, 4C:
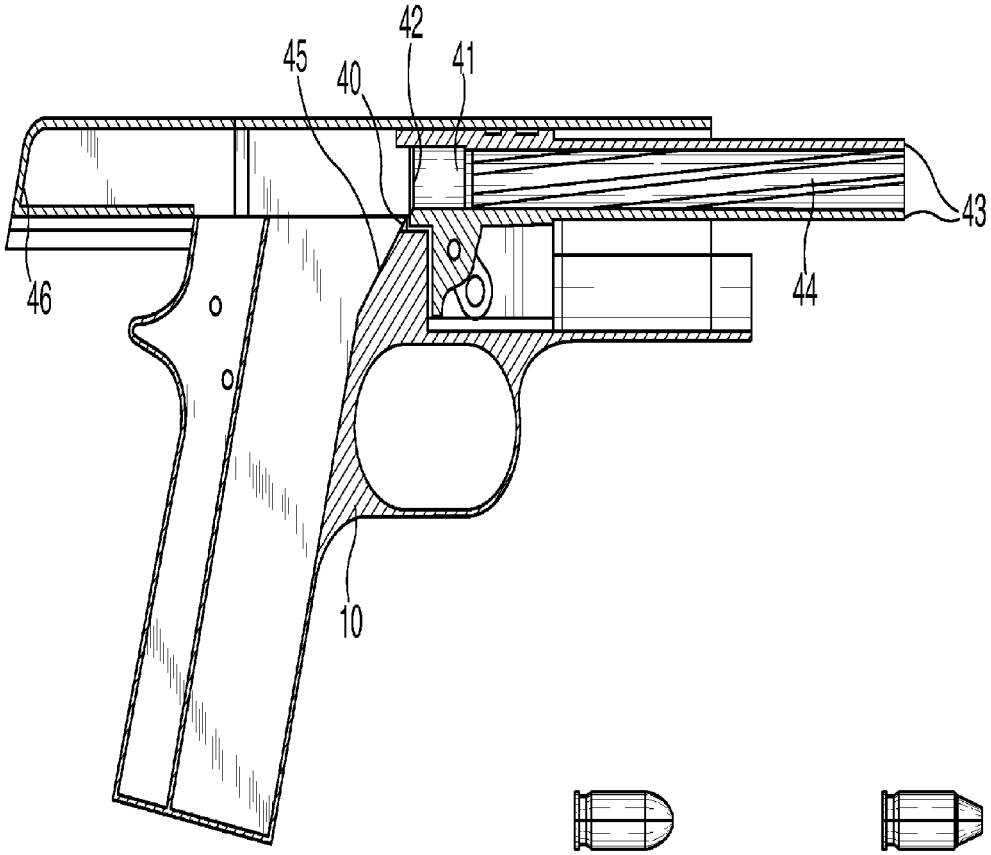
FIG. 4A is a cross section of a modified Colt 1911 style handgun illustrating the high feed ramp according to the invention.
FIGS. 4B and 4C are round and cast bullets respectively.

FIG. 4A is a cross section of a modified Colt 1911 style handgun illustrating the high feed ramp according to the invention. The integral little relief rim extension on the upper edge of the frame feed ramp 40 is shown along with the high frame feed ramp 45. The high feed ramp on the frame can be obtained by milling on the receiver metal a little relief rim extension. The barrel breech: chamber or boiler room 41 includes a small chamfered 42 around the inner breech, in such a way it can support the pressure on all the case surface upon firing. The wall of the barrel 43 the drop barrel 44, as well as the slide 46 of the gun are shown. FIGS. 4B and 4C show a round and cast bullet respectively.

Figures 5A, 5B, 5C:
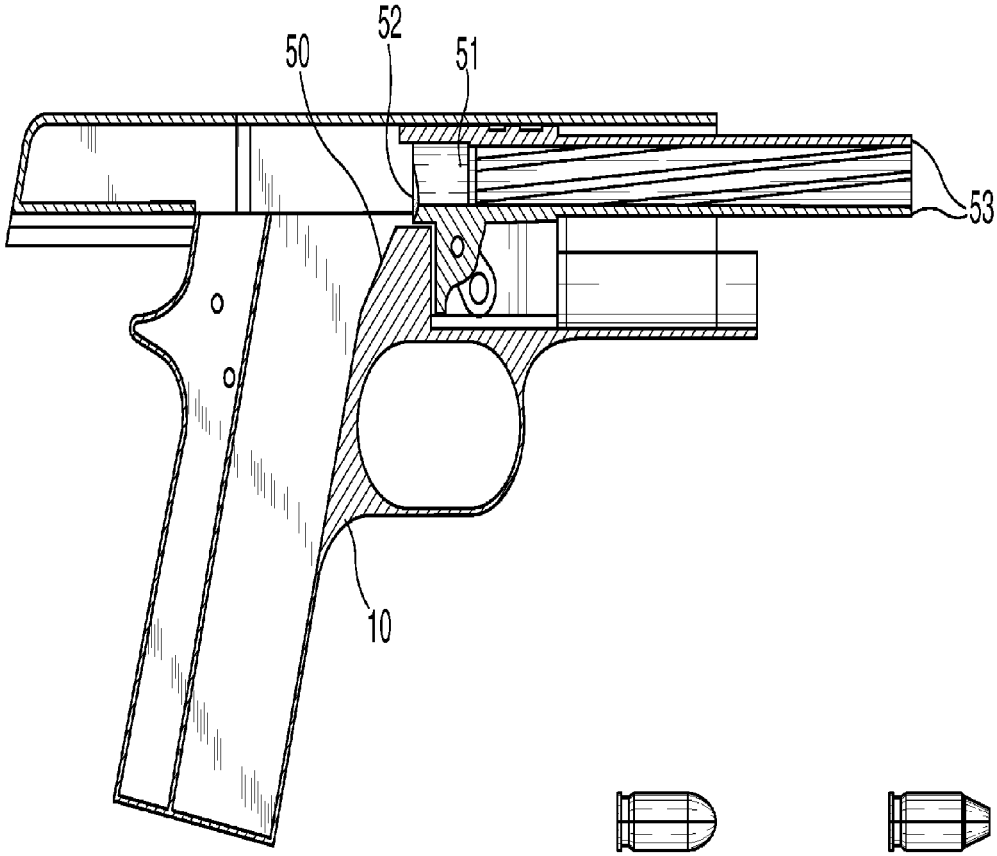
FIG. 5A is a cross section of a Colt 1911 style handgun illustrating the prior art short feed ramp (like the Colt Company manufacturers it)
FIGS. 5B and 5C are round and cast bullets respectively.

FIG. 5A is a cross section of a Colt 1911 style handgun illustrating the prior art short feed ramp and the bottom barrel blade of the chamfered breech (like the Colt Company makes it). The old short feed ramp 50, the boiler room 51 and the bottom barrel edge blade of the inner chamfered breech 52 is shown. The surface chamber (or boiler room) has a large bottom edge blade around the inner chamfered breech. The frame or receiver 10 is also shown.

Figure 6A:
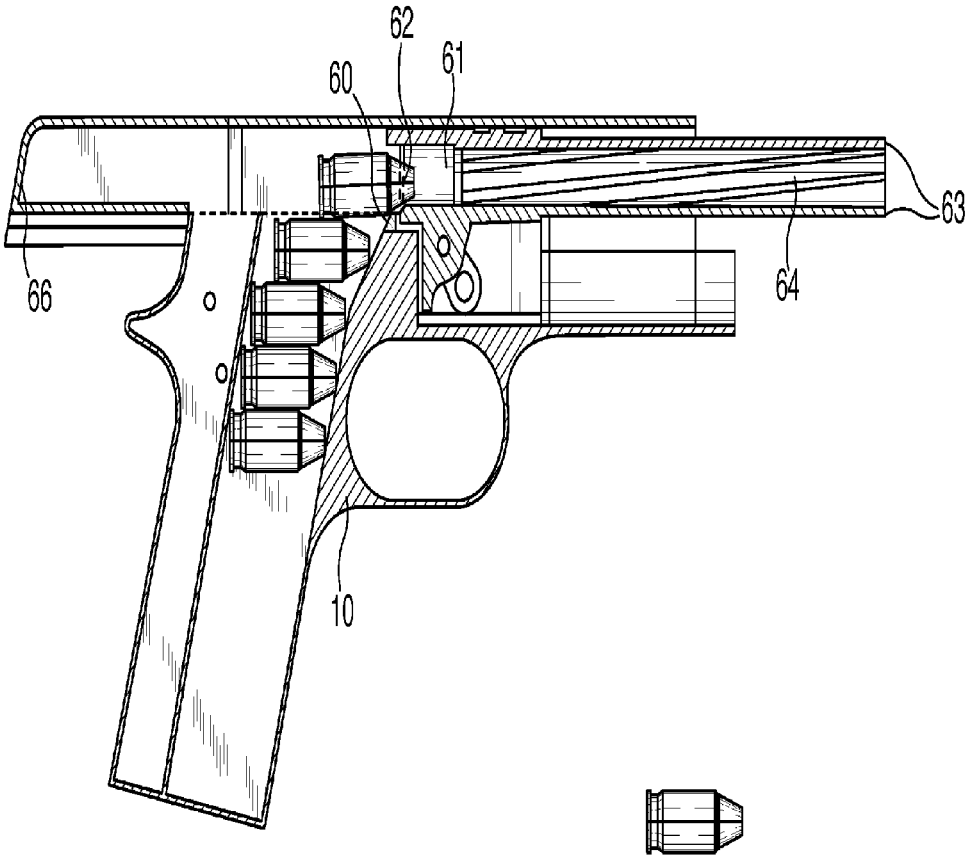
FIG. 6A is a cross section of a modified Colt 1911 style handgun according to the invention illustrating the movement of the semi wad-cutter bullets.
Figure 6B:
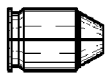
FIG. 6B is a cast bullet.

FIG. 6A is a cross section of a modified Colt 1911 style handgun according to the invention illustrating the movement of the semi wad-cutter bullets. The invention ramp is used in a Colt 1911 style handgun to improve the feeding of semi-wad cutter flat point bullets. The integral little relief rim extension on the upper edge of the frame feed ramp 60 is shown along with the high frame feed ramp 65. The high feed ramp on the frame can be obtained by milling on the receiver metal a little relief rim extension. The barrel breech: chamber or boiler room 61 includes a small chamfered 62 around the inner breech, in such a way it can support the pressure on all the case surface upon firing. The wall of the barrel 63 the drop barrel 64 as well as the slide 66 of the gun are shown. FIG. 6B show a cast bullet.

Figure 7:
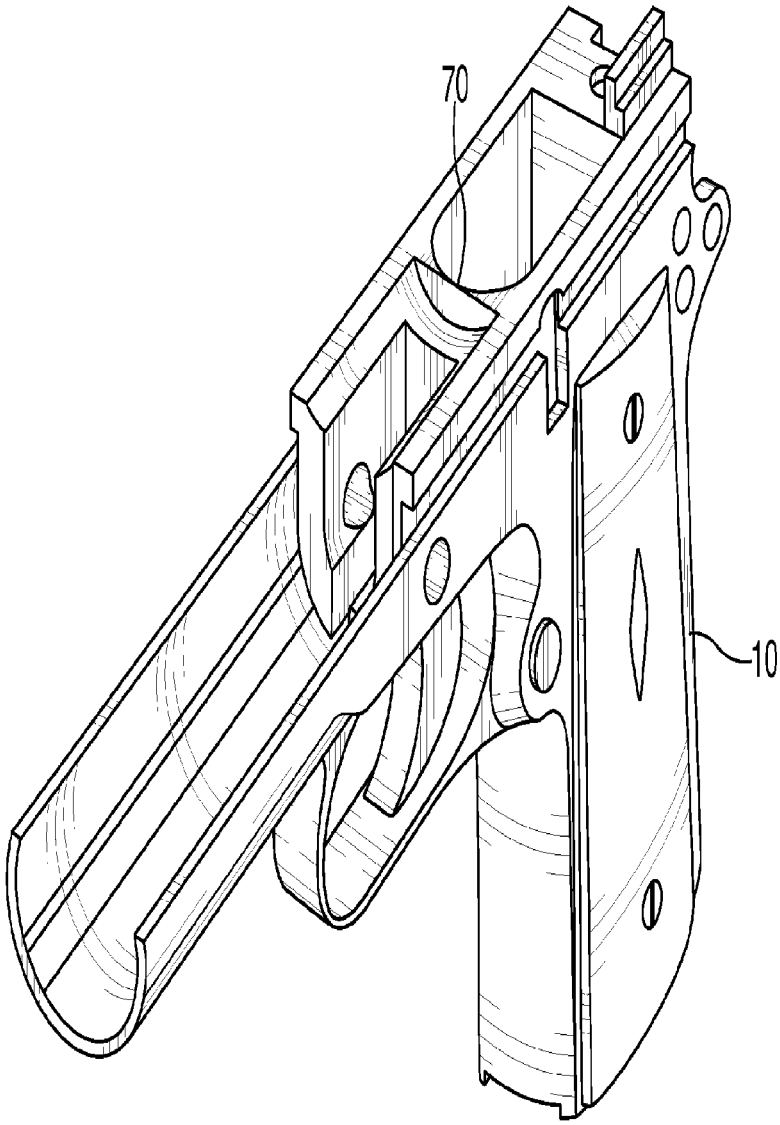
FIG. 7 is a front view perspective of the invention without the barrel and illustrating the relief rim extension on the upper-edge of the frame.

FIG. 7 is a front perspective view of the invention without the barrel where the high feed ramp has been milled on the receiver metal. The relief rim extension 70 on the upper edge of the frame 10 is shown.

Figure 8:
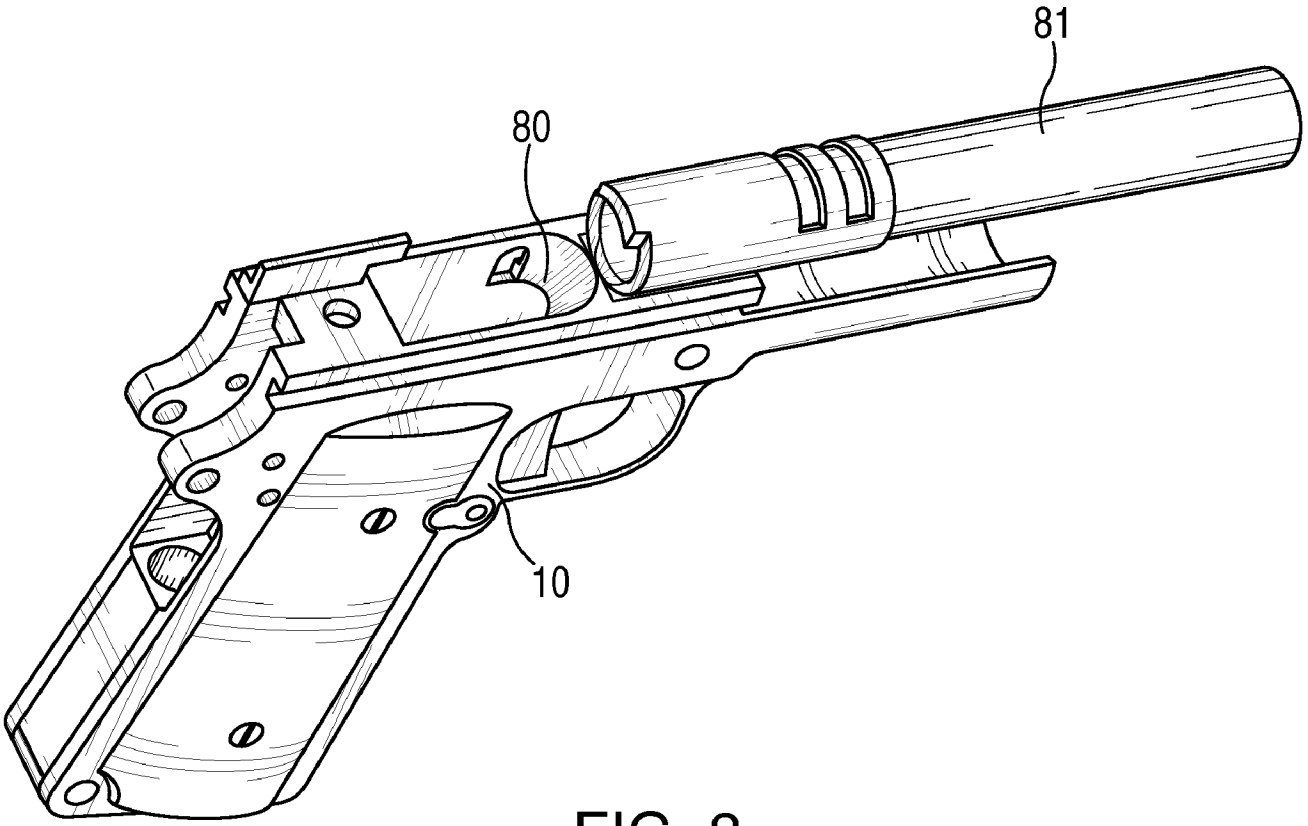
FIG. 8 is a rear view perspective of the invention with the barrel and illustrating the high feed ramp on the receiver of a Colt 1911 45 ACP system.

FIG. 8 is a rear perspective view of the invention with the barrel 81. The high fee ramp or extended feed ramp 80 is shown on the receiver frame of a Colt 1911 45 ACP system.

The mechanism of the Colt 1911 45-ACP is a recoil locked-breech swinging link drop barrel. Upon firing the barrel and the slide backward together for a fraction of an inch until the swinging link causes the barrel to swing downward and stop on the receiver beyond the low edge of the frame feed ramp.

The drop barrel breech is without a feed ramp and upon firing the barrel breech recoils and goes down and stops on the receiver beyond the frame feed ramp. Without the integral relief rim extension of the invention, the bullet point can collide and jam or jerk on the bottom edge blade of the chamfered barrel breech and the gun will be misfire.

As described the invention modification is a high feed ramp milling made on the receiver metal, specifically an integral relief rim extension on the upper edge of the frame feed ramp behind the recoil stop of the drop barrel breech. As illustrated in FIGS. 3A and 3B and FIG. 4.

When the gun fires the integral little relief rim extension on the upper edge of the frame feed ramp drives a flat point bullet easily into the barrel boiler room without jamming on the bottom edge blade of the chamfered barrel breech so that the gun doesn't misfire. This happens because when a fresh cartridge chambers into the barrel the flat point bullet slides on the integral little relief extension (high feed ramp) into the barrel chamber such that the flat point bullet doesn't collide with the bottom edge blade of the chamfered boiler room. The cartridge easily chambers in the barrel and the gun can fire properly.

The Colt 1911 hand gun, with the invention structural modification, will never jam or misfire. It can also handle a wide variety of bullets commercially available on the market, i.e. from ball to jacketed hollow points and semi-wad cutter flat points. The modified Colt 1911 45-ACP with the high feed ramp relief rim extension fires without problems and will last a long while and it will never jam or misfire again.

The extended feed ramp permits the gun to work fine with cast bullet flat point. A test was performed with eight rounds of flat point bullets in the magazine. The gun performed perfectly and did not jam.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A high feed ramp for use in Colt 1911 style handguns, the handguns include a frame, barrel and barrel breech, comprising:

a feed ramp on the frame having an upper edge near the barrel breach for guiding bullets into the barrel of the gun; wherein said barrel breech is between the feed ramp and the barrel, and has a chamfered around the entire inner circumference of said barrel breach near the feed ramp; and on said upper edge of said feed ramp an integral relief rim extension is present, such that the feed ramp is extended over the bottom edge of said chamfered barrel breach;

wherein when the handgun is fired the bullets easily enter into the barrel and do not jam or misfire due to improper loading of the bullets.

2. The high feed ramp according to claim 1 wherein the handgun includes semi-automatic pistols and drop barrel guns.

3. A handgun including a receiver, barrel and boiler room comprising:

a feed ramp on the receiver having an upper edge near the boiler room for guiding bullets into the barrel of the gun;

wherein said boiler room is between the feed ramp and the barrel, and has a chamfered the entire inner circumference of said boiler room near the feed ramp; on said upper edge of said feed ramp an integral relief rim extension is present, such that the feed ramp is extended over the bottom edge of said chamfered boiler room;

wherein the gun has no barrel feed ramp edge blades and the bullets can easily enter into the barrel and do not jam or misfire due to improper loading of the bullets when the handgun has been fired.

4. The handgun according to claim 1, wherein further the handgun is a semi-automatic pistol and drop barrel gun.

* * * * *